United States Patent [19]

Wehrli et al.

[11] Patent Number: 5,016,323

[45] Date of Patent: May 21, 1991

[54] HIGH-DRAFT DRAFTING DEVICE FOR A FLYERLESS SPINNING PROCESS

[75] Inventors: Rudolf Wehrli, Winterthur; Herbert Stalder, Kollbrunn, both of Switzerland

[73] Assignee: Rieter Machine Works, Ltd., Winterthur, Switzerland

[21] Appl. No.: 401,621

[22] Filed: Aug. 31, 1989

[30] Foreign Application Priority Data

Aug. 30, 1988 [CH] Switzerland ..... 03260/88

[51] Int. Cl.[5] ..... D01H 5/32

[52] U.S. Cl. ..... 19/258

[58] Field of Search ..... 19/244, 249, 252, 256

[56] References Cited

U.S. PATENT DOCUMENTS

| | | | |
|---|---|---|---|
| 3,748,694 | 7/1973 | Staneff | 19/258 |
| 4,387,487 | 6/1983 | Nakahara et al. | 19/249 |
| 4,398,320 | 9/1983 | Kubota et al. | 19/236 |
| 4,592,114 | 6/1986 | Stahlecker | 19/258 |

FOREIGN PATENT DOCUMENTS

| | | | |
|---|---|---|---|
| 0945822 | 7/1956 | Fed. Rep. of Germany . | |
| 1112433 | 8/1961 | Fed. Rep. of Germany . | |
| 3039149 | 5/1981 | Fed. Rep. of Germany . | |
| 513129 | 5/1976 | U.S.S.R. | 19/258 |
| 1227727 | 4/1986 | U.S.S.R. | 19/258 |
| 0883823 | 12/1961 | United Kingdom . | |

OTHER PUBLICATIONS

Wegener, Walter Die Streckwerke Der Spinnereimaschinen, Springer-Verlag, 1965, pp. 193 to 243.

*Primary Examiner*—Werner H. Schroeder
*Assistant Examiner*—John J. Calvert
*Attorney, Agent, or Firm*—Kenyon & Kenyon

[57] ABSTRACT

The drawframe has a preliminary drafting zone with a draft of from 4 to 8 as well as a main drafting zone with a draft of at least 30. In addition, a deflecting rod is disposed in the preliminary drafting zone in order to deflect the flow of fiber by about 1 millimeter. The deflecting rod is positioned centrally between the nips of the rollers defining the preliminary drafting zone. The guide surface of the deflecting rod may be convexly rounded not only transversely but also longitudinally in guiding the fiber flow thereover.

10 Claims, 1 Drawing Sheet

HIGH-DRAFT DRAFTING DEVICE FOR A FLYERLESS SPINNING PROCESS

Figure 1:
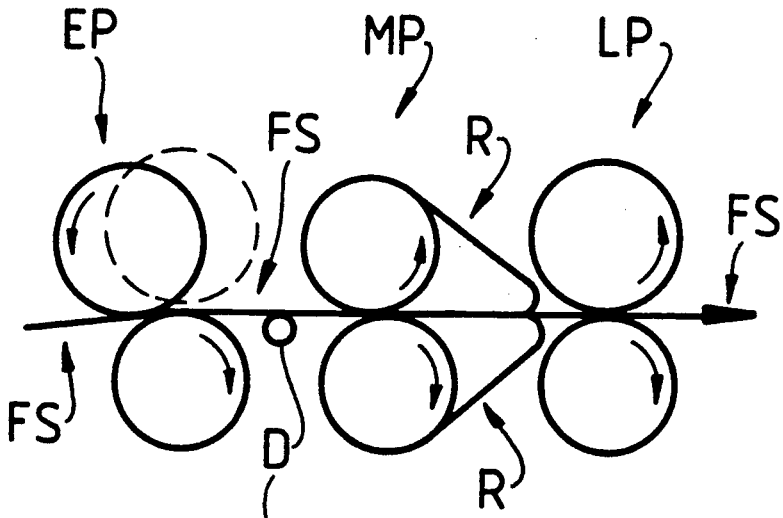

This invention relates to a high-draft drafting device. More particularly, this invention relates to a high-draft drafting device for a flyerless spinning process.

The development of flyerless spinning processes up to the middle of the 1960's is described in "Die Streckwerke der Spinnereimaschinen", book by Dr. Ing. Walter Wegener (Springer-Verlag, 1965 Edition, pages 193 to 243). The same book describes the constructions and operation of the various drawframe systems. More particularly, pages 245 and 246 of the 1965 edition describe the "pressure-rod drafting device" for the high-capacity frame manufactured by a British firm at that time, Platt Brothers (Sales) Ltd.

Since then, some additional flyerless spinning processes have been developed, based on supplying the fiber material for spinning to a drafting device. The drafting devices for these spinning processes need to operate with a very high total draft, which far exceeds the draft of the conventional modern ring spinner. The latter machine is of course designed to process the roving after preliminary drafting by the flyer.

As roving is already slightly twisted, the drafting device of a ring spinner consequently has two functions, i.e., to eliminate the twist of the roving and to refine untwisted material to the yarn number (by drafting).

The first function is fulfilled by the preliminary drafting zone of the drafting device, where a very small draft (1.1 to 1.3) is sufficient. The actual drafting is brought about in the main drafting zone, normally at the maximum possible draft for a single zone (about 40 or often up to 50 times).

A high-draft drafting device therefore normally comprises at least one preliminary drafting zone and one main drafting zone, i.e. at least three pairs of rollers. It is well-known nowadays to use special methods of optimizing the fiber supply in the main drafting zone. These methods includes the use of a pressure-rod as in the aforementioned "pressure-rod drafting device" by Messrs. Platt Brothers.

It is also known to improve the fiber guidance in the preliminary drafting zone, more particularly when processing short-staple fibers by disposing a condenser around the fiber flow between the input and middle pair of rollers in a two-zone drafting device. Difficulties may be caused, however, if new feed material (a sliver or roving) is introduced into the condenser.

It is also known from German Patent 945 822 to dispose a feed-material tension sensor in the preliminary drafting zone and to control the preliminary drafting in accordance with the output signal from the sensor. The sensor comprises a detecting element which has to deflect the flow of fibers in order to generate a tension signal. The deflection produced by the sensor must be variable, so that the output signal can vary with the tension on the feed material.

Accordingly, it is an object of the invention to provide a drafting device which has a high-draft.

It is another object of the invention to provide a drafting device with a high-draft in excess of 150.

It is another object of the invention to be able to subject a flow of fiber material to a high-draft in a drafting device without impairing the resulting yarn values.

Briefly, the invention provides a high-draft drafting device with at least one preliminary drafting zone and at least one main drafting zone. Preferably, the main drafting zone produces a draft greater than 30 and the preliminary drafting zone produces a draft greater than 2, i.e. the drafting device produces a total draft of at least 60.

The drafting device also has a component for predetermined deflection of the fiber flow disposed in the preliminary drafting zone. The preliminary drafting zone can be one of a number of such zones, each zone being optimally provided with a respective fiber deflection component. Advantageously, the component may also be constructed as a fiber-flow limiting means for limiting the spread of the fiber flow in the preliminary drafting zone. Since, however, a component of this kind does not surround the fiber flow but leaves the fiber flow free in at least one direction, the use of this component does not produce any additional problems when new feed material is introduced into the drafting device.

The aforementioned deflection of the fiber flow can be obtained by mounting the component on a holding means, either rigidly or so that the component cannot yield under the pressure exerted by the fiber flow.

The width : height ratio of the feed material at the component should be chosen so that the maximum number of fibers are subjected to tensile force at the component. The ratio is preferably at least 3 : 1 or even better at least 4 : 1. Advantageously, the component is disposed in the central region of the preliminary drafting zone, i.e. in the middle third of the distance between the two nips of the preliminary drafting zone.

The drafting device may advantageously be used in a spinning machine for converting a feed of untwisted material into a yarn. The tex of the material on insertion into the drafting device can be far greater than the tex of the roving for a ring spinner, e.g. over 1000 tex. For this reason, the entire system must have a very high draft (more than 150), which necessitates a relatively high draft (preferably at least 4) in the preliminary drafting zone.

Figure 2:
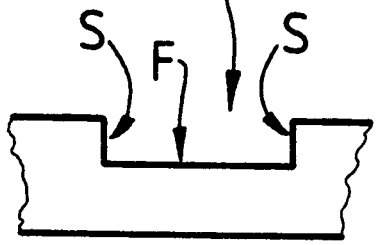
Figure 3:
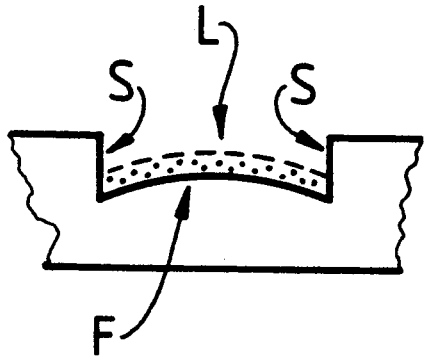

These and other objects and advantages of the invention will become more apparent from the following detailed description taken in conjunction with the accompanying drawings wherein:

FIG. 1 diagrammatically illustrates a side view of a drafting device constructed in accordance with the invention;

FIG. 2 illustrates a partial cross sectional view of a deflecting rod in accordance with the invention; and FIG. 3 illustrates a modified recess of a deflecting rod in accordance with the invention.

Referring to FIG. 1, the drafting device is constructed for a jet spinner and comprises a pair of delivery rollers LP, a middle pair of rollers MP and a pair of input rollers EP. Fiber material for spinning is drawn from left to right into the drafting device from a suitable feed (not shown) and is drafted and conveyed by the delivery rollers LP to a jet system (not shown) for false-twist spinning. The feed material has a tex of over 1000.

The input rollers EP and the middle rollers MP together form a preliminary drafting zone having a draft advantageously in the range from 4 to 8. The middle rollers MP and delivery rollers LP together form a main drafting zone having a draft preferably greater than 30 and possibly about 40. The drafting device shown is constructed as a "double apron drafting device", i.e. the top and bottom rollers of the middle pair MP each have an apron R which extends from the respective roller into the main drafting zone, in order to improve the guidance of fibers in this zone. This system, however, is not essential. An alternative solution based on a "Kepa" drafting device system as described in Swiss patent application No. 2723/88 can also be used.

Means in the form of a pressure rod D is disposed in the preliminary drafting zone downstream of the input rollers EP in order to slightly deflect the fiber flow FS in this zone and, thus, improve the fiber guidance in this drafting zone. The improved fiber guidance is evident from an improvement in the yarn values attainable by the spinning station, i.e. by an increase in tensile strength and stretch and a reduction in CV Uster values, thins, thicks and neps.

The improvement is due to the fact that the shorter fibers in particular (but preferably as many fibers as possible) are exposed to a frictional force at the pressure rod in a direction perpendicular to a straight line between the nips of the preliminary drafting zone. The frictional forces at the pressure rod limit the acceleration region in the drafting zone, i.e. the region in which shorter fibers are accelerated to the higher speed of the downstream pair of rollers.

In a preferred embodiment, (a variant of which is shown in FIG. 2) the fiber guide surface F of the pressure rod D has a recess defined by a pair of "shoulders" S for laterally bounding the spread of the fiber flow in the preliminary drafting zone. The guide surface F should be convexly rounded in the direction of the fiber now.

The pressure rod D serving as a deflector for the fiber flow, is preferably rigidly mounted on a holder (not shown) The holder can be stationary and mounted on the drafting device, or can be rotatable around a separate longitudinal axis.

The position of the pressure rod D in the preliminary drafting zone is important for optimum action and is preferably disposed approximately in the center of the zone, i.e. between the two nip lines bounding the zone.

FIG. 1 shows the pressure rod D on the "under" side of the feed material, i.e. on the same side as the positively driven rollers. Alternatively, the pressure rod D could be disposed on the other side of the feed material. The required deflection of the fibers is very small; a deflection of about 1 millimeter relative to the path of the fibers in the absence of the rod D is sufficient to give the required frictional force and the resulting improvements.

The rod need not necessarily be round (cylindrical) but preferably has the aforementioned convex fiber-guiding surface F. Alternatively, the surface F can be convex in the transverse direction as shown in FIG. 3. FIG. 3 also shows (chain lines) the preferred configuration of the feed material at the pressure rod, i.e. a relatively thin wide layer. The width of the layer is preferably in the proportion 4 : 1 or more to the depth.

FIG. 1 shows two possible positions of the two rollers of the input pair EP relative to one another. The upper (pressure) roller can be disposed either vertically above the lower roller (chain-line) or offset in the direction of the feed (continuous line). The latter variant is advantageous in combination with a feed-material stop device according to Swiss patent application No. 2957/88.

The length of the preliminary drafting zone (between the nips of rollers EP and MP) may normally (without the pressure rod) be not considerably longer than the average staple length of the material for processing. However, the fiber-guiding rod can also be used to increase the length of the preliminary drafting zone, which is advantageous for maintenance work there, since less adjustment work is required when altering the staple.

The invention thus provides a drafting device which is capable of a high-draft, for example, a draft in excess of 150.

Further, the invention provides a high-draft drawframe in which the resulting yarn values of the flow of fiber material in the drafting device are improved.

What is claimed is:

1. A high-draft drafting device for a flyerless spinning process comprising at least one main drafting zone defined between a first pair of separated nips for drafting a flow of fiber material for spinning;

at least one preliminary drafting zone defined between a second pair of separated nips for drafting and delivering the flow of fiber material to said main drafting zone; and means centrally disposed in said preliminary drafting zone for deflecting the flow of fiber material extending therein to impose a frictional force thereon in a direction perpendicular to a straight line between said second pair of separated nips.

2. A drafting device as set forth in claim 1 wherein said means includes a rod rigidly mounted on a stationary holder and extending transversely of said preliminary drafting zone.

3. A drafting device as set forth in claim 2 wherein said rod has a recess for receiving and bounding the flow of fiber therethrough.

4. A drafting device as set forth in claim 3 wherein said recess has a convex base.

5. A high-draft drafting device comprising a pair of input rollers defining a first nip for delivering a flow of fiber material therethrough;

a pair of middle rollers defining a second nip for passage of the flow of fiber material and defining a preliminary drafting zone with said delivery rollers;

a pair of delivery rollers defining a third nip for passage of the flow of fiber material and defining a main drafting zone with said middle rollers having a greater draft than said preliminary drafting zone; and a pressure rod disposed centrally in said preliminary zone between said first nip and second nip to deflect the fiber flow in said preliminary zone, said rod being positioned to deflect the fiber flow about one millimeter from a straight line path between said first nip and said second nip.

6. A drafting device as set forth in claim 5 wherein said rod has a convexly rounded surface in the direction of fiber flow for passage of the fiber flow thereover.

7. A drafting device as set forth in claim 5 wherein said rod has a transversely disposed convex surface for passage of the fiber flow thereover.

8. A drafting device as set forth in claim 5 wherein said preliminary drafting zone has a draft in the range of from 4 to 8 and said main drafting zone has a draft of at least 30.

9. A drafting device as set forth in claim 8 wherein said preliminary drafting zone and said main drafting zone have a total draft of more than 150.

10. A high-draft drafting device comprising a pair of input rollers defining a first nip for delivering a flow of fiber material therethrough;

a pair of middle rollers defining a second nip for passage of the flow of fiber material and defining a preliminary drafting zone with said delivery rollers;

a pair of delivery rollers defining a third nip for passage of the flow of fiber material and defining a main drafting zone with said middle rollers having a greater draft than said preliminary drafting zone; and a pressure rod disposed in said preliminary zone to deflect the fiber flow in said preliminary zone, said rod having a transversely disposed convex surface for passage of the fiber flow thereover.

* * * * *